US006872091B2

(12) United States Patent
Huang

(10) Patent No.: US 6,872,091 B2
(45) Date of Patent: Mar. 29, 2005

(54) COAXIAL ELECTRICAL CONNECTOR WITH A SWITCHING FUNCTION

(75) Inventor: Cheng-I Huang, Tainan Hsien (TW)

(73) Assignee: Dynahz Technologies Corporation, Kaohsiung (TW)

( * ) Notice: Subject to any disclaimer, the term of this patent is extended or adjusted under 35 U.S.C. 154(b) by 0 days.

(21) Appl. No.: 10/746,027

(22) Filed: Dec. 23, 2003

(65) Prior Publication Data

US 2004/0214462 A1 Oct. 28, 2004

(30) Foreign Application Priority Data

Apr. 23, 2003 (CH) ..... 92206439 U

(51) Int. Cl.[7] ..... H01R 29/00
(52) U.S. Cl. ..... 439/578; 439/188; 200/51.1
(58) Field of Search ..... 439/578, 581–583, 439/188; 200/51.1

(56) References Cited

U.S. PATENT DOCUMENTS 6,572,405 B2 * 6/2003 Lin et al. ..... 439/578
6,619,876 B2 * 9/2003 Vaitkus et al. ..... 403/349
6,655,464 B2 * 12/2003 Chau et al. ..... 166/380
2002/0160657 A1 10/2002 Boillot

* cited by examiner

*Primary Examiner*—Truc Nguyen
(74) *Attorney, Agent, or Firm*—Darby & Darby

(57) ABSTRACT

A coaxial electrical connector includes a tubular body, first, second and third insulator members, a contact piece, and a central conductor unit. The tubular body defines a through hole, and is formed with a radial hole. The first and second insulator members are mounted in the through hole and are spaced apart from each other. The third insulator member is mounted in the radial hole. The contact piece extends into the third insulator member. The central conductor unit is supported in the through hole by the first and second insulator members, and includes a first conductor component coupled telescopically to a second conductor component. The first conductor component is movable to make or break contact with the contact piece.

4 Claims, 1 Drawing Sheet

COAXIAL ELECTRICAL CONNECTOR WITH A SWITCHING FUNCTION

CROSS-REFERENCE TO RELATED APPLICATION

This application claims priority of Taiwanese application no. 092206439, filed on Apr. 23, 2003.

BACKGROUND OF THE INVENTION

1. Field of the Invention

The invention relates to a coaxial electrical connector, more particularly to a coaxial electrical connector with a switching function.

2. Description of the Related Art

U.S. Pat. No. 6,547,592 discloses a coaxial electrical connector element that provides a switching function and that comprises a central conductor, an external conducting body forming a ground contact, a contact piece, and a conducting socket. The conducting socket can move axially about the central conductor, between a first position, in which it simultaneously bears against the central conductor and the contact piece, and a second position, in which it is spaced from the contact piece. A return member is provided for urging the conducting socket into its first position. The return member consists of an elastically deformable tubular piece engaged around the central conductor. The tubular piece is placed in the conducting body so as to be held therein by a cylindrical end part while still being able to deform radially owing to axial displacement of the conducting socket during mating with a complementary connector element. The socket is designed to push the free end of the tubular piece axially backward.

In view of the foregoing, the aforesaid connector element provides a switching function for signal transmission between the complementary connector element and the central conductor or between the contact piece and the central conductor.

The aforesaid connector element permits signal transmission through the central conductor that is surrounded by the return member made of an insulator material. However, according to studies in radio frequency design principles, the insulating effect attributed to insulator materials is inferior to that achieved by air. Therefore, a radio frequency signal conducted by the central conductor will be unavoidably attenuated through the return member and the external conducting body. Based on actual tests, under the condition VSWR<1.5, a radio frequency that can be conducted by the aforesaid connector element has a maximum value of 3 GHz. Therefore, an improvement on the applicable operating frequency of the coaxial electrical connector element is highly desired.

On the other hand, the switching function of the aforesaid connector element relies on the resiliency of the return member, which also provides an insulating function. These requirements restrict the return member to be made from a material, such as rubber, which does not have resiliency and adaptability to ambient environment conditions, such as temperature, superior to those of a metal compression spring. Therefore, the biasing effect for urging the conducting socket is prone to degrade after a period of use due to elastic fatigue. Lastly, the switching function of the aforesaid connector element is possible due to the cooperative action of numerous components, such as the central conductor, the return member and the conducting socket, which is relatively complicated and prone to malfunction.

SUMMARY OF THE INVENTION

Therefore, the main object of the present invention is to provide a coaxial electrical connector that can overcome the aforesaid drawbacks of the prior art.

Accordingly, a coaxial electrical connector of this invention comprises a tubular body, a first insulator member, a second insulator member, a third insulator member, a contact piece, and a central conductor unit. The tubular body has a tube wall that surrounds a tube axis, that defines a through hole, and that is formed with a radial hole. The first insulator member is mounted in the through hole. The second insulator member is mounted in the through hole and is spaced apart from the first insulator member along the tube axis. The first and second insulator members cooperate with the tube wall to configure the through hole with a switching section. The radial hole is registered with the switching section of the through hole. The third insulator member is mounted in the radial hole. The contact piece has a first contact end that extends into the switching section of the through hole, and a second contact end that extends into the third insulator member in the radial hole. The central conductor unit includes a first conductor component, a second conductor component, and a restoring component. The first conductor component extends along the tube axis and has a contact portion that extends movably through the first insulator member, and a coupling portion that is disposed in the switching section of the through hole. The second conductor component extends along the tube axis and has a contact portion that extends non-movably through the second insulator member, and a coupling portion that is disposed in the switching section of the through hole and that is coupled telescopically to the coupling portion of the first conductor component. The coupling portion of the first conductor component has a contact surface that is disposed radially relative to the tube axis. The first conductor component is movable along the tube axis from a first position, where the contact surface of the coupling portion of the first conductor component abuts against the first contact end of the contact piece, to a second position, where the contact surface of the coupling portion of the first conductor component is spaced apart from the first contact end of the contact piece. The restoring component serves to bias the first conductor component to one of the first and second positions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
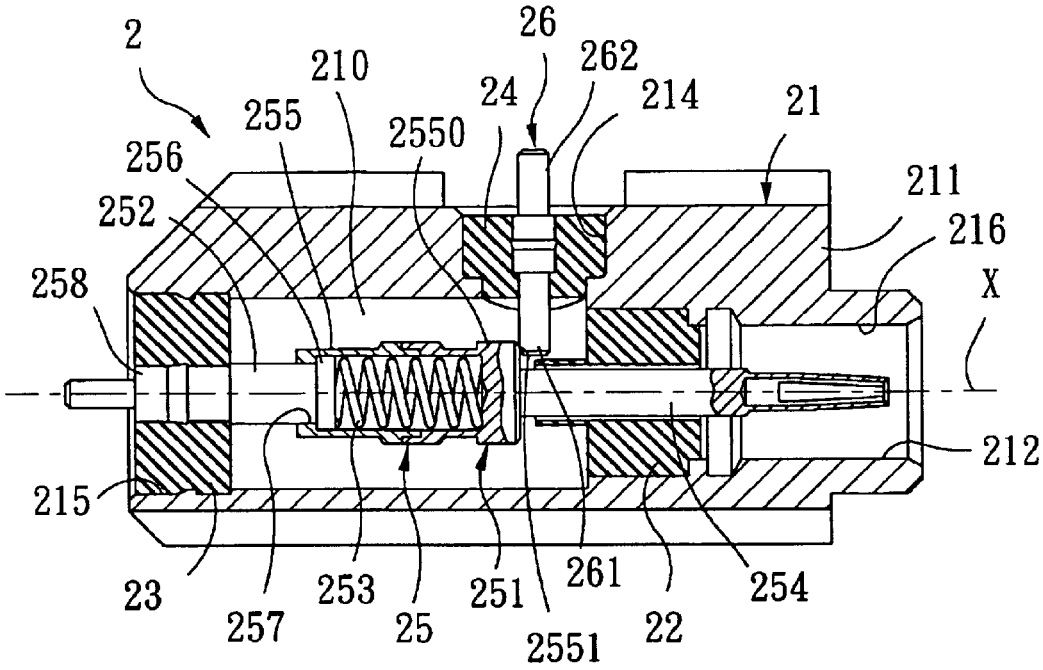
FIG. 1 is an assembled sectional view of the preferred embodiment of a coaxial electrical connector according to the present invention, illustrating a state where a first conductor component is disposed in a first position.

Referring to FIG. 1, the preferred embodiment of a coaxial electrical connector 2 according to the present invention is adapted for use in a wireless local area network so as to switch transmission from an antenna module originally designed for a printed circuit board to an indoor or outdoor antenna with a higher gain.

The coaxial electrical connector 2 is shown to include a tubular body 21, a first insulator member 22, a second insulator member 23, a third insulator member 24, a contact piece 26, and a central conductor unit 25.

The tubular body 21 has a tube wall 211 that surrounds a tube axis (X), that defines a through hole 212 having opposite hole end parts 215, 216, and that is formed with a radial hole 214 with a hole axis transverse to the tube axis (X).

The first insulator member 22 is mounted fittingly in the through hole 212 adjacent to the hole end part 216. The second insulator member 23 is mounted fittingly in the through hole 212 at the hole end part 215 and is thus spaced apart from the first insulator member 21 along the tube axis (X). The first and second insulator members 22, 23 cooperate with the tube wall 211 to configure the through hole 212 with a switching section 210. The radial hole 214 is registered with the switching section 210 of the through hole 212. The third insulator member 24 is mounted fittingly in the radial hole 214.

The contact piece 26 has a first contact end 261 that extends into the switching section 210 of the through hole 212, and a second contact end 262 that extends fixedly into the third insulator member 24 in the radial hole 214.

The central conductor unit 25 includes a first conductor component 251, a second conductor component 252, and a restoring component 253.

The first conductor component 251 extends along the tube axis (X) and has a contact portion 254 that extends movably through the first insulator member 22, and a coupling portion 255 that is disposed in the switching section 210 of the through hole 212 and that is formed with a radial outward flange 2550. The flange 2550 is provided with a contact surface 2551 that is disposed radially relative to the tube axis (X).

The second conductor component 252 extends along the tube axis (X) and has a contact portion 258 that extends fixedly and non-movably through the second insulator member 23, and a coupling portion 256 that is disposed in the switching section 210 of the through hole 212 and that is coupled telescopically to the coupling portion 255 of the first conductor component 251. In this embodiment, the coupling portion 255 of the first conductor component 251 is formed with a tubular sleeve 257 that is sleeved on the coupling portion 256 of the second conductor component 252.

In this embodiment, the restoring component 253 is a compression spring that is disposed in the tubular sleeve 257 and that has opposite ends abutting against the first and second conductor components 251, 252, respectively. Accordingly, the restoring component 253 biases the first and second conductor components 251, 252 away from each other in the electrical connector 2 of this embodiment.

Figure 2:
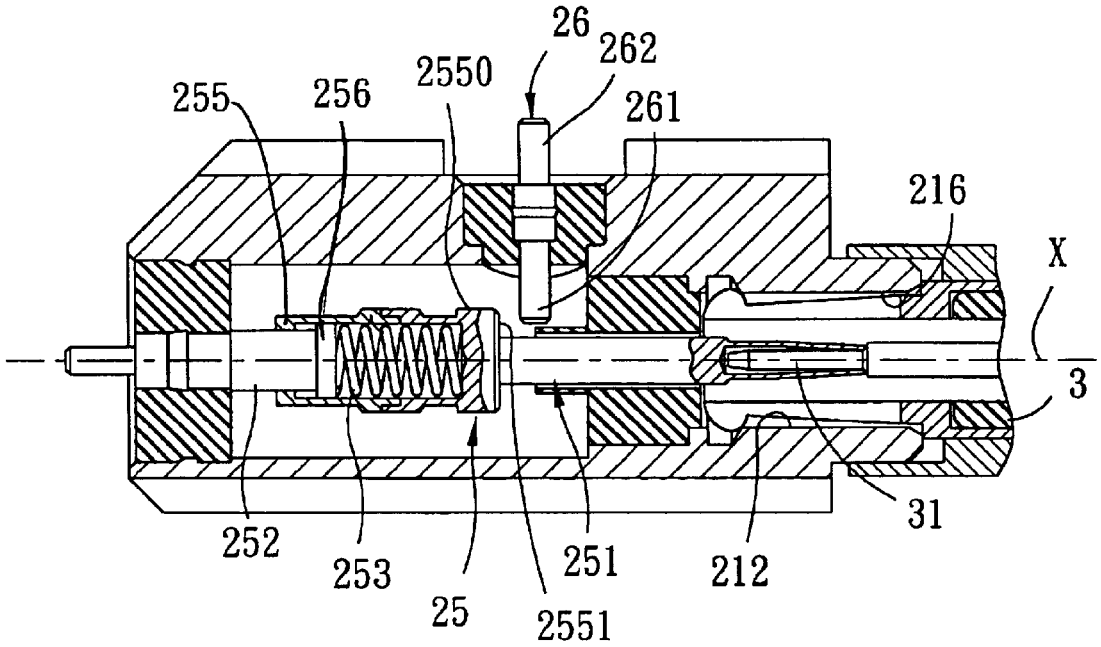
FIG. 2 is a view similar to FIG. 1, illustrating a state where the first conductor component is disposed in a second position.

When the electrical connector 2 is in use, the first conductor component 251 is movable along the tube axis (X) against biasing action of the restoring component 253 from a first position, where the contact surface 2551 of the coupling portion 255 of the first conductor component 251 abuts against the first contact end 261 of the contact piece 26 to establish electrical connection between the contact piece 26 and the central conductor unit 25, as best shown in FIG. 1, to a second position, where the contact surface 2551 of the coupling portion 255 of the first conductor component 251 is spaced apart from the first contact end 261 of the contact piece 26 as a result of mating engagement between the first conductor component 251 and a terminal 31 of a complementary electrical connector 3 that is inserted into the hole end part 216 of the tubular body 21, as best shown in FIG. 2. In this embodiment, by virtue of the restoring component 253, the first conductor component 251 is restored to the first position when the complementary electrical connector 3 is removed.

Since the coupling portions 255, 256 of the first and second conductor components 251, 252 are disposed in the switching section 210 of the through hole 212 and are surrounded by air and not by an insulator material, and since air has a superior insulating effect as compared to insulator materials, signal loss during transmission through the central conductor unit 25 will be lower as compared to the prior art. Moreover, based on actual test results, under the condition VSWR<1.5, a radio frequency that can be conducted by the coaxial electrical connector of this invention can be as high as 8 GHz, which is a dramatic improvement over the prior art.

Furthermore, the switching function of the coaxial electrical connector 2 of this invention relies simply on movement of the first conductor component 251 between the first and second positions relative to the second conductor component 252 along the tube axis (X), without involving other cooperating components. Moreover, the restoring component 253 can be in the form of a metal compressing spring having characteristics of better resiliency and a longer service life as compared to rubber components.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A coaxial electrical connector comprising:

a tubular body having a tube wall that surrounds a tube axis, that defines a through hole, and that is formed with a radial hole;

a first insulator member mounted in said through hole;

a second insulator member mounted in said through hole and spaced apart from said first insulator member along the tube axis, said first and second insulator members cooperating with said tube wall to configure said through hole with a switching section, said radial hole being registered with said switching section of said through hole;

a third insulator member mounted in said radial hole;

a contact piece having a first contact end that extends into said switching section of said through hole, and a second contact end that extends into said third insulator member in said radial hole; and a central conductor unit including a first conductor component extending along the tube axis and having a contact portion that extends movably through said first insulator member, and a coupling portion that is disposed in said switching section of said through hole, a second conductor component extending along the tube axis and having a contact portion that extends non-movably through said second insulator member, and a coupling portion that is disposed in said switching section of said through hole and that is coupled telescopically to said coupling portion of said first conductor component, said coupling portion of said first conductor component having a contact surface that is disposed radially relative to the tube axis, said first conductor component being movable along the tube axis from a first position, where said contact surface of said coupling portion of said first conductor component abuts against said first contact end of said contact piece, to a second position, where said contact surface of said coupling portion of said first conductor component is spaced apart from said first contact end of said contact piece, and a restoring component for biasing said first conductor component to one of the first and second positions.

2. The coaxial electrical connector as claimed in claim 1, wherein said coupling portion of said first conductor component is formed with a tubular sleeve that is sleeved on said coupling portion of said second conductor component.

3. The coaxial electrical connector as claimed in claim 2, wherein said restoring component is a compression spring that is disposed in said tubular sleeve and that has opposite ends abutting against said first and second conductor components, respectively.

4. The coaxial electrical connector as claimed in claim 1, wherein said coupling portion of said first conductor component is formed with a radial outward flange that is provided with said contact surface.

* * * * *